US005548259A

United States Patent [19]

Ide et al.

[11] Patent Number: 5,548,259

[45] Date of Patent: Aug. 20, 1996

[54] ELECTROMAGNETIC RELAY HAVING AN IMPROVED RESISTIVITY TO SURGE

[75] Inventors: Tatsumi Ide; Yasuhisa Nishi, both of Tokyo, Japan

[73] Assignee: NEC Corporation, Tokyo, Japan

[21] Appl. No.: 309,676

[22] Filed: Sep. 21, 1994

[30] Foreign Application Priority Data

Sep. 21, 1993 [JP] Japan ..... 5-234711

[51] Int. Cl.[6] ..... H01H 51/22

[52] U.S. Cl. ..... 335/78; 335/128; 335/80

[58] Field of Search ..... 335/78–80, 128, 335/124, 131

[56] References Cited

U.S. PATENT DOCUMENTS 4,504,809 3/1985 Lueker et al. ..... 335/78

5,015,978 5/1991 Yokoo et al. ..... 335/80

*Primary Examiner*—Lincoln Donovan

*Attorney, Agent, or Firm*—Young & Thompson

[57] ABSTRACT

An electromagnetic relay having an improved resistivity to a surge comprising an enclosure member, a core provided in the enclosure member, coils winding the core through a spool, an armature showing an alternate motion to be in contact with or apart from a part of the core, and a contact member showing an alternate motion to be in contact with or apart from a part of each of contact terminals secured to the enclosure member and the contact member being electrically separated from and mechanically connected to the armature through an insulating material having an extremely large dielectric constant.

19 Claims, 4 Drawing Sheets

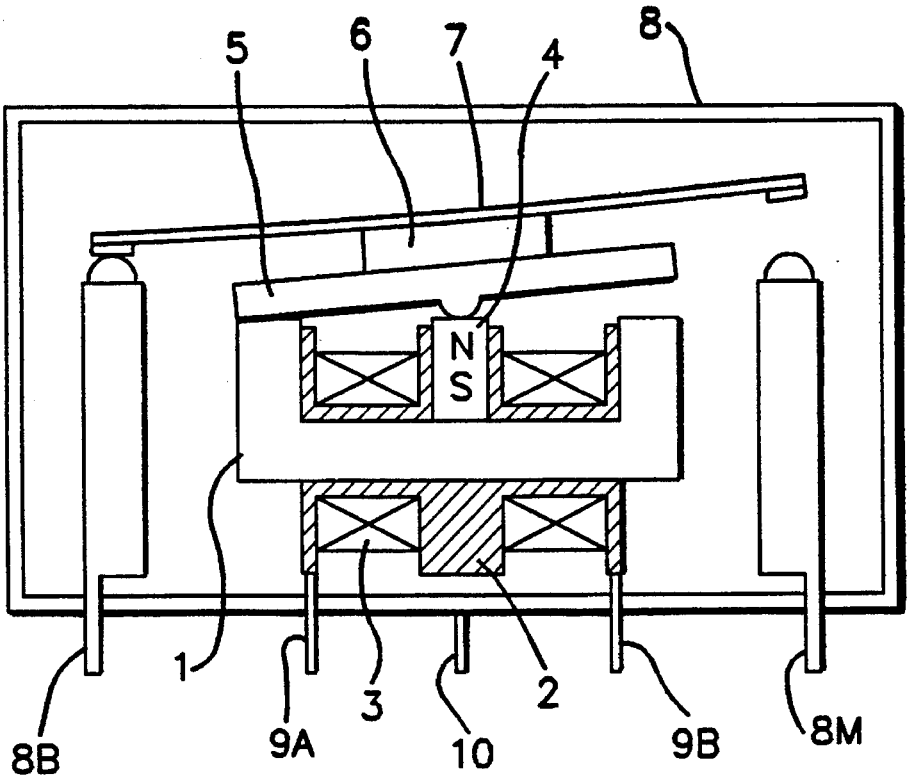
FIG. 1
PRIOR ART
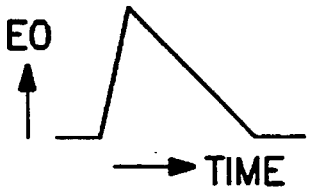
FIG. 2A
FIG. 2B
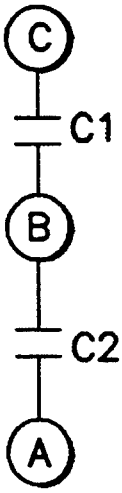
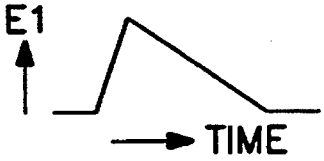
FIG. 2C
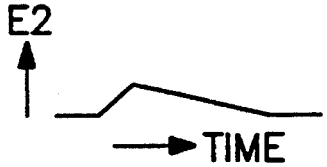
FIG. 2D

ELECTROMAGNETIC RELAY HAVING AN IMPROVED RESISTIVITY TO SURGE

BACKGROUND OF THE INVENTION

1. Field of the Invention

The invention relates to an electromagnetic relay, and more particularly to a structure of an electromagnetic relay having a resistivity to surge, that is useful for an apparatus receiving a surge such as lightning.

2. Description of the Related Art

A typical conventional relay has a basic structure that comprises an electromagnetic driving unit, a movable contact spring member and fixed contact terminals. A conventional polarized relay having dipoles of a magnetic will be described with reference to FIG. 1. The conventional polarized relay is accommodated in an enclosure member 8. The polarized relay has an electromagnetic driving unit that comprises an U-shaped core 1, a spool 2 surrounding the core 1, a coil 3 winding the spool 2, a permanent magnet 4 having magnetic dipoles N and S poles and coil terminals 9A and 9B projecting through the enclosure member 8. The polarized relay also has a movable contact unit that comprises an armature 5, an insulator 6 and a movable contact spring member 7. The armature 5 has a center convex portion that is kept in contacting with a polar face of the permanent magnet 4 and having opposite end portions that are alternatively contact with and apart from tops of the U-shaped core 1. The movable contact spring member 7 is mechanically connected to or electrically separated from the armature 5 through the insulator 6. The polarized relay also has fixed contact terminals 8B and 8M provided around the electromagnetic driving unit. The fixed contact terminals 8B and 8M have a bottom projected downwardly from a bottom face of the enclosure member 8 and a top portion located within the enclosure member 8. The movable contact spring member 7 shows a rotation about its center portion caused by or together with the rotation of the armature 5 so that its opposite ends are alternately contact with or apart from the tops of the fixed contact terminals 8B and 8M. The relay further has a movable contact terminal 10 projected downwardly from a bottom face of the enclosure member 8.

When the electromagnetic relay is applied to apparatus in the fields of communications and households, it is required to protect the apparatus from any surges due to interferences among a thunder surge, commercial power lines and communication lines. Achievement of such protection requires the coil terminals 9A and 9B, the fixed terminals 8B and 8M, the movable contact spring member 7 and a movable contact terminal 10 to have resistivities against a relatively large surge voltage. The conventional relays have been engaged with serious problems the resistivities of the large surge voltages. When the relay receives a surge whose voltage waveform is illustrated in FIG. 2A, the relay shows electrical responses illustrated in FIGS. 2C and 2D wherein the relay may be regarded as a structure comprising three terminals A, B and C connected in series through two floating static capacitances C1 and C2. The terminal A represents the coil terminals 9A an 9B. The terminal B represents electrically floating members such as the core 1 and the armature 5. The terminal C represents the fixed contact terminals 8B and 8M and the movable contact terminal 10. Then, a surge voltage E0 applied between the terminals A and C is divided by the floating static capacitors C1 and C2. A surge voltage E1 between the terminals B and C is given by the following equation (1), while a surge voltage E2 between the terminal A and B is given by the following equation (2).

$$E1=E0\times C2/(C1+C2) \quad (1)$$

$$E2=E0\times C1/(C1+C2) \quad (2)$$

From the above equations, it could readily be understood that if the values of the two floating static capacitances C1 and C2 are unbalanced or have a large difference from each other, then the surge voltages E1 and E2 are unbalanced or have a large difference. Normally, the floating static capacitance C2 tends to be larger than the floating static capacitance C1 as the coil 3 is so winded around the extremely thin spool 2 as to have a possible large winding density in order to improve an efficiency in electromagnetic conversion. The floating static capacitance C1 is mainly defined by the insulator 6 that mechanically connects the movable spring member 7 to the armature 5. In view of securing a necessary length of the movable contact string member or a voltage resistivity particularly in scaling down, it is difficult to enlarge the floating static capacitance C1. The most of the surge voltage E0 is applied between the terminals B and C. This may provide a breakdown voltage between the terminals B and C. The breakdown between the terminals B and C may further provide a breakdown voltage between the terminals A and B. Then this results in a further breakage between the terminals A and B. Consequently, this results in a breakage between the terminals A and C. To prevent this problem if the distance between the armature and the movable contact spring member is increased or the insulator is inserted between the armature and the movable contact spring member to improve the voltage resistivity between the terminals A and B, then this may act as a bar to scaling down of the electromagnetic relay or a bar to an achievement of high speed performance of the armature.

It has been required to develop a novel electromagnetic relay free from any problems.

SUMMARY OF THE INVENTION

Accordingly, it is a primary object of the present invention to provide a novel electromagnetic relay free from any problems as described above.

It is an another object of the present invention to provide a novel electromagnetic relay having a resistivity to a high surge voltage.

It is a further object of the present invention to provide a novel electromagnetic relay suitable for a scaling down.

It is a still further object of the present invention to provide a novel electromagnetic relay showing a high speed performance.

The above and other objects, features and advantages of the present invention will be apparent from the following descriptions.

The invention provides an electromagnetic relay having an improved resistivity to a surge comprising an enclosure member accommodating the relay, a core provided in the enclosure member, coils winding the core through a spool, an armature showing an alternate motion to be in contact with or apart from a part of the core, and a contact member showing an alternate motion to be in contact with or apart from a part of each of contact terminals secured to the enclosure member and the contact member being electrically separated from and mechanically connected to the armature through an insulating material having an extremely high dielectric constant. The insulating material comprises an engineering plastic including a foreign material having a higher dielectric constant than a dielectric constant of the engineering plastic.

BRIEF DESCRIPTIONS OF THE DRAWINGS

Preferred embodiments of the present invention will hereinafter fully be described in detail with reference to the accompanying drawings.

FIG. 1 is a cross sectional view illustrative of the conventional polarized electromagnetic relay.

FIGS. 2A to 2D are diagrams illustrative of voltage waveforms of surge and divided voltages as well as an equivalent circuit of the relay.

PREFERRED EMBODIMENTS OF THE INVENTION

Figure 3:
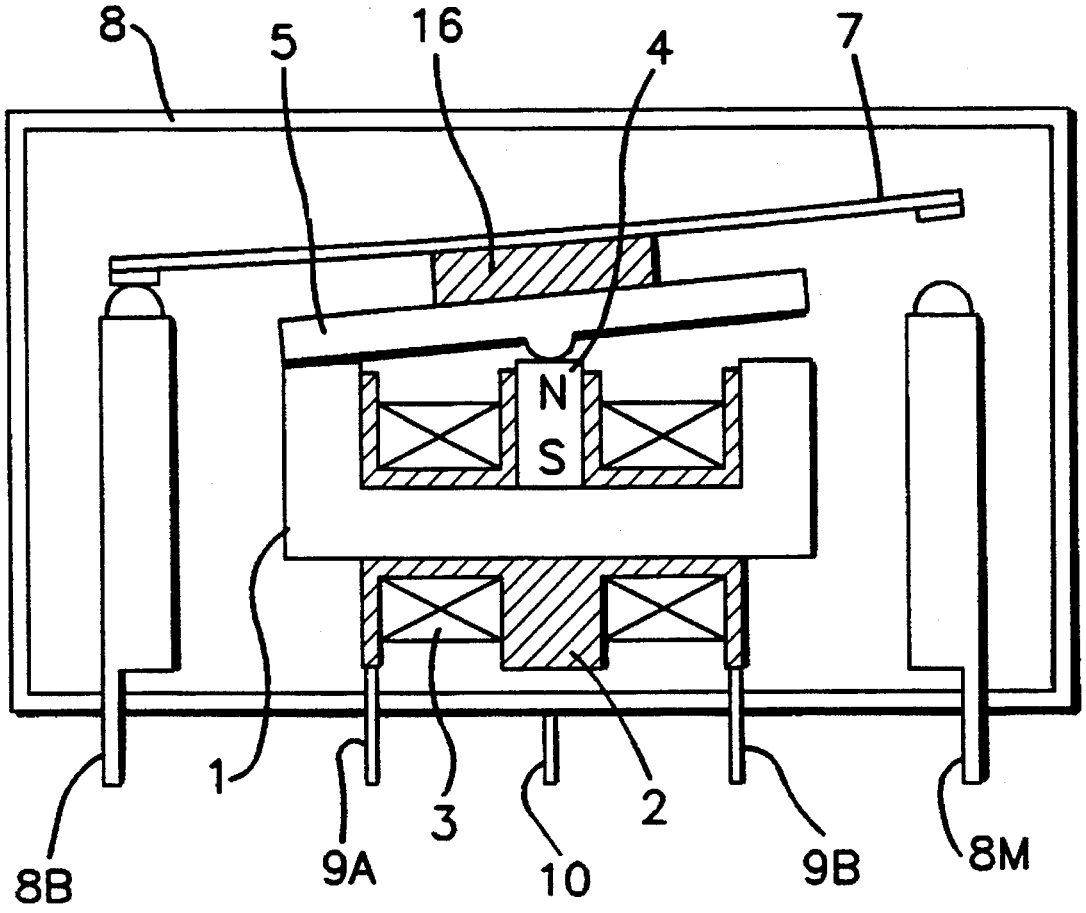
FIG. 3 is a cross sectional view illustrative of a novel polarized electromagnetic relay in a first embodiment according to the present invention.

A first embodiment according to the present invention will be described with reference to FIG. 3 in which a novel polarized electromagnetic relay having a high resistivity against any large surge voltage.

A novel polarized electromagnetic relay of this embodiment has a difference from the prior art in an insulator mechanically connecting between an armature and a movable contact spring member. The insulator may be made of specific materials as described below. The polarized electromagnetic relay is accommodated in an enclosure member 8. The polarized electromagnetic relay comprises an electromagnetic driving unit, a movable contact unit and a fixed contact terminal unit. The electromagnetic driving unit comprises an U-shaped core 1, a spool 2 extending on and surrounding the core 1, a coil 3 winding the spool 2, a permanent magnet 4 having magnetic dipoles or N and S poles and coil terminals 9A and 9B projecting downwardly through a bottom of the enclosure member 8. The movable contact unit comprises an armature 5, an insulator 16 and a movable contact spring member 7. The armature 5 has a center convex portion that is kept in contact with a polar face of the permanent magnet 4 and having opposite end portions that are alternately in contact with and apart from tops of the U-shaped core 1. The movable contact spring member 7 is mechanically connected to or electrically separated from the armature 5 through the insulator 16. The polarized relay also has fixed contact terminals 8B and 8M provided around the electromagnetic driving unit. The fixed contact terminals 8B and 8M have a bottom projected downwardly from a bottom face of the enclosure member 8 and a top portion located within the enclosure member 8. The movable contact spring member 7 shows a rotation motion about its center portion caused by or together with the rotation of the armature 5 so that its opposite ends are alternately in contact with or apart from the tops of the fixed contact terminals 8B and 8M. The relay further has a movable contact terminal 10 projected downwardly from a bottom face of the enclosure member 8.

The insulator 16 for mechanically connecting but electrically separating the movable contact spring member 7 to the armature 5 is a molded material comprising an engineering plastic including duplex grains of barium titanate in which the engineering plastic may be either polybutylene-terephthalate or polyethylene-terephthalate. Such engineering plastics have a dielectric constant in the range of from 3 to 6, while barium titanate has a higher dielectric constant of approximately 1200. A dispersion of the higher dielectric constant material such as barium titanate into the molded engineering plastic may provide the insulator 16 with an enlargement in the effective dielectric constant by three or four times as compared to the effective dielectric constant of the engineering plastic. The enlargement of the dielectric constant of the insulator 16 may provide a considerable increase of a floating static capacitor between a first group comprising electrically floating members such as the core 1 and the armature 5 and a second group comprising the fixed contact terminals 8B and 8M and the movable contact terminal 10. Referring back to FIGS. 2A to 2D, the introduction of the higher dielectric constant material such as barium titanate into the molded engineering plastic may result in a considerable increase of a floating static capacitor C1 between the terminals B and C. This may permit that the surge voltage EO received by the relay is well uniformly divided into the floating static capacitances C1 and C2. This may prevent the relay from any breakdown voltage among the terminals A, B and C. or the relay is kept from any breakage. This means that the relay of this embodiment possesses a high resistivity to a large surge. Then this may facilitate scaling down of the electromagnetic relay and an achievement of high speed performance of the armature.

The floating static capacitor C1 may readily be controlled by controlling a ratio in amount of the duplex highly dielectric constant material such as barium titanate to the engineering plastic. Increase of the amount of barium titanate may provide an increase of the floating static capacitor C1. Comparison of the novel relay with the prior art in the resistivity to the surge voltage was carried out under the following conditions. The relay has 15 mm×10 mm×10 mm in size. The applied surge EO has a voltage rising time of 2 microseconds and a voltage drop down time of 10 microseconds. The conventional relay has the floating static capacitance C1 of approximately 3 pF showing a resistivity to a surge of 1.8 KV and the floating static capacitance C2 of approximately 10 pF showing a resistivity to a surge of 2 KV. Then the conventional relay has a resistivity to the surge voltage of 2.3 KV. By contrast, the relay with the same sizes of this embodiment shows a resistivity to a high surge voltage in the range of from 3.5 to 4 KV.

As modifications of the first embodiment, the material of the insulator 16 having the high dielectric constant may be a molded material prepared by mixing a powdered glass with the high dielectric constant material barium titanate. Such insulator material 16 may provide the same advantages as described above. The material having the high dielectric constant may be useful to be mixed into the majority material for the insulator 16. Polyfluorovinyl, a silicone resin, a melamineformaldehyde resin, a nitrile rubber, a fluorine-contained rubber and a polyurethane rubber may be available for the material of the insulator 16. Further, titanic acid ceramic, alumina, steatite, mica, granite, marble, a soda glass and a lead glass may be available as the high dielectric constant material to be mixed into the engineering plastic as described above.

Figure 4:
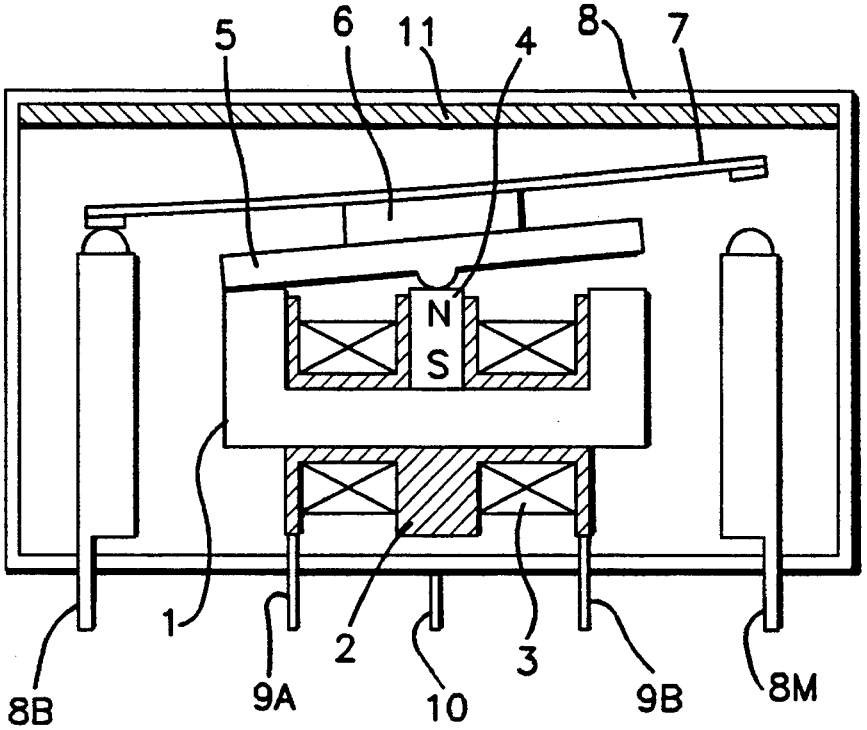
FIG. 4 is a cross sectional view illustrative of a novel polarized electromagnetic relay in a second embodiment according to the present invention.

A second embodiment according to the present invention will be described with reference to FIG. 4 in which a novel polarized electromagnetic relay having a high resistivity against any large surge voltage.

A novel polarized electromagnetic relay of this embodiment has a difference from the prior art in providing a metal material 11 on an inner face of a top plate of an enclosure member accommodating the relay. The polarized electromagnetic relay is accommodated in an enclosure member 8. The polarized electromagnetic relay comprises an electromagnetic driving unit, a movable contact unit and a fixed contact terminal unit. The electromagnetic driving unit comprises an U-shaped core 1, a spool 2 extending on and surrounding the core 1, a coil 3 winding the spool 2, a permanent magnet 4 having magnetic dipoles or N and S poles and coil terminals 9A and 9B projecting downwardly through a bottom of the enclosure member 8. The movable contact unit comprises an armature 5, an insulator 6 and a movable contact spring member 7. The armature 5 has a center convex portion that is kept in contact with a polar face of the permanent magnet 4 and having opposite end portions that are alternately in contact with and apart from tops of the U-shaped core 1. The movable contact spring member 7 is mechanically connected to or electrically separated from the armature 5 through the insulator 6. The polarized relay also has fixed contact terminals 8B and 8M provided around the electromagnetic driving unit. The fixed contact terminals 8B and 8M have a bottom projected downwardly from a bottom face of the enclosure member 8 and a top portion located within the enclosure member 8. The movable contact spring member 7 shows a rotation motion about its center portion caused by or together with the rotation of the armature 5 so that its opposite ends are alternately in contact with or apart from the tops of the fixed contact terminals 8B and 8M. The relay further has a movable contact terminal 10 projected downwardly from a bottom face of the enclosure member 8. The enclosure member 8 has a top plate with an inner face on which a metal film 11 is either formed by evaporation or sputtering or may be a metal plate.

The metal film 11 may serve as an opposite electrode to the armature in the form of a floating static capacitance between a first group comprising electrically floating members such as the core 1 and the armature 5 and a second group comprising the fixed contact terminals 8B and 8M and the movable contact terminal 10. Referring back to FIGS. 2A to 2D, then this may provide an increase of the floating static capacitance C1. This may permit that the surge voltage EO received by the relay is well uniformly divided into the floating static capacitances C1 and C2. This may prevent the relay from any breakdown voltage among the terminals A, B, and C. or the relay is kept from any breakage. This means that the relay of this embodiment possesses a high resistivity to a large surge. Then this may facilitate scaling down of the electromagnetic relay and an achievement of high speed performance of the armature.

Figure 5:
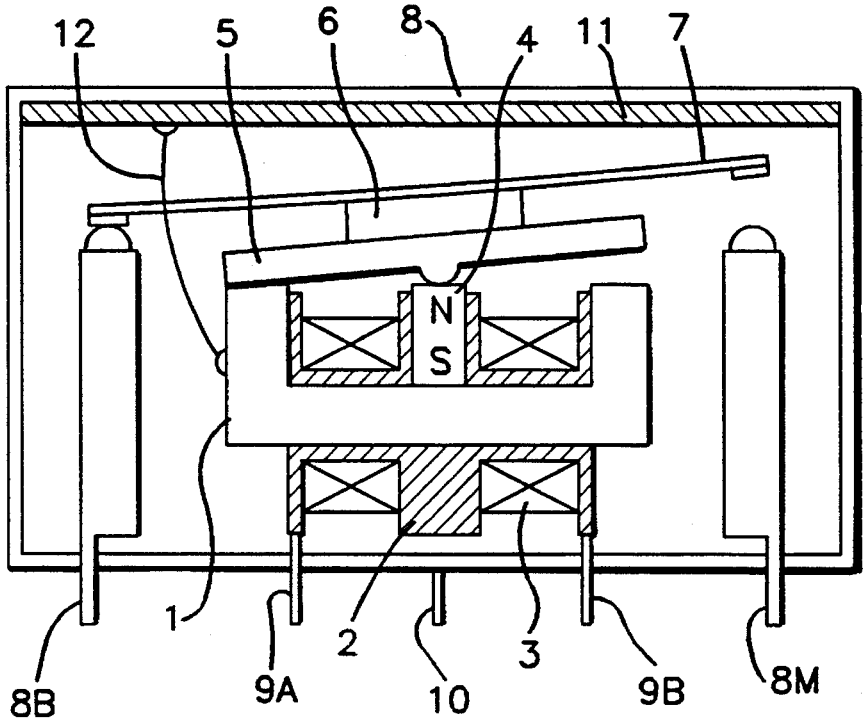
FIG. 5 is a cross sectional view illustrative of a novel polarized electromagnetic relay in a three embodiment according to the present invention.

A third embodiment according to the present invention will be described with reference to FIG. 5 in which a novel polarized electromagnetic relay having a high resistivity against any large surge voltage.

A novel polarized electromagnetic relay of this embodiment has a difference from the second embodiment in providing an electrical connection between a core and a metal film formed on an inner face of a top plate of an enclosure member accommodating the relay. The electrical connection between the metal film and the core may be achieved by providing a wiring between them. The polarized electromagnetic relay is accommodated in an enclosure member 8. The polarized electromagnetic relay comprises an electromagnetic driving unit, a movable contact unit and a fixed contact terminal unit. The electromagnetic driving unit comprises an U-shaped core 1, a spool 2 extending on and surrounding the core 1, a coil 3 winding the spool 2, a permanent magnet 4 having magnetic dipoles or N and S poles and coil terminals 9A and 9B projecting downwardly through a bottom of the enclosure member 8. The movable contact unit comprises an armature 5, an insulator 6 and a movable contact spring member 7. The armature 5 has a center convex portion that is kept in contact with a polar face of the permanent magnet 4 and having opposite end portions that are alternately in contact with and apart from tops of the U-shaped core 1. The movable contact spring member 7 is mechanically connected to or electrically separated from the armature 5 through the insulator 6. The polarized relay also has fixed contact terminals 8B and 8M provided around the electromagnetic driving unit. The fixed contact terminals 8B and 8M have a bottom projected downwardly from a bottom face of the enclosure member 8 and a top portion located within the enclosure member 8. The movable contact spring member 7 shows a rotation motion about its center portion caused by or together with the rotation of the armature 5 so that its opposite ends are alternately in contact with or apart from the tops of the fixed contact terminals 8B and 8M. The relay further has a movable contact terminal 10 projected downwardly from a bottom face of the enclosure member 8. The enclosure member 8 has a top plate with an inner face on which a metal film 11 is either formed by evaporation or sputtering or may be a metal plate. The relay further includes a wiring 12 between the core 1 and the metal film 11 for providing an electrical connection between them.

As described in the second embodiment, the metal film 11 may serve as an opposite electrode to the armature in the form of the floating static capacitance C1. This may increase the floating static capacitance C1. Further, the wiring 12 providing the electrical connection between the metal film 11 and the core 1 may provide a further increase of the floating static capacitance C1. This may permit that the surge voltage E0 received by the relay is well uniformly divided into the floating static capacitances C1 and C2. This may prevent the relay from any breakdown voltage among the terminals A, B and C. or the relay is kept from any breakage. This means that the relay of this embodiment possesses a high resistivity to a large surge. Then this may facilitate scaling down of the electromagnetic relay and an achievement of high speed performance of the armature.

As modifications of this embodiment, it is available to either provide an another wiring between the metal film 11 and the armature 5 or provide the wiring 12 between the metal film 11 and the core 1 and a further wiring between the metal film 11 and the armature 5. Such modifications may also provide the relay with the same advantages as described above.

Figure 6:
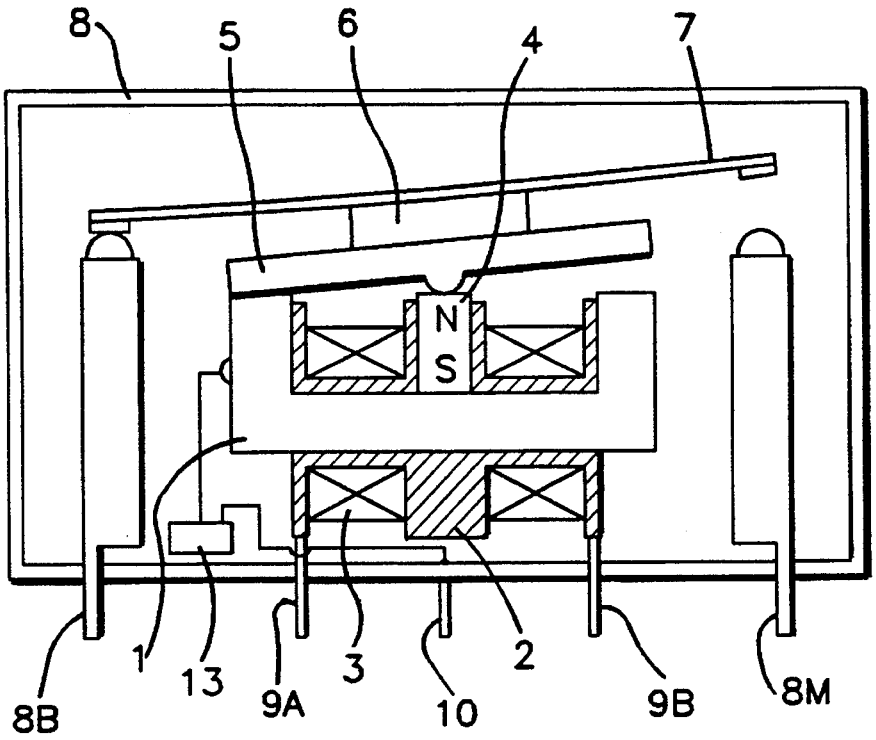
FIG. 6 is a cross sectional view illustrative of a novel polarized electromagnetic relay in a fourth embodiment according to the present invention.

A fourth embodiment according to the present invention will be described with reference to FIG. 6 in which a novel polarized electromagnetic relay having a high resistivity against any large surge voltage.

A novel polarized electromagnetic relay of this embodiment has a difference from the prior art in providing capacitor between a core and a movable contact terminal formed to projecting downwardly from a bottom plate of an enclosure member in which the relay is accommodated. The polarized electromagnetic relay comprises an electromagnetic driving unit, a movable contact unit and a fixed contact terminal unit. The electromagnetic driving unit comprises an U-shaped core 1, a spool 2 extending on and surrounding the core 1, a coil 3 winding the spool 2, a permanent magnet 4 having magnetic dipoles or N and S poles and coil terminals 9A and 9B projecting downwardly through a bottom of the enclosure member 8. The movable contact unit comprises an armature 5, an insulator 6 and a movable contact spring member 7. The armature 5 has a center convex portion that is kept in contact with a polar face of the permanent magnet 4 and having opposite end portions that are alternately in contact with and apart from tops of the U-shaped core 1. The movable contact spring member 7 is mechanically connected to or electrically separated from the armature 5 through the insulator 6. The polarized relay also has fixed contact terminals 8B and 8M provided around the electromagnetic driving unit. The fixed contact terminals 8B and 8M have a bottom projected downwardly from a bottom face of the enclosure member 8 and a top portion located within the enclosure member 8. The movable contact spring member 7 shows a rotation motion about its center portion caused by or together with the rotation of the armature 5 so that its opposite ends are alternately in contact with or apart from the tops of the fixed contact terminals 8B and 8M. The relay further has a movable contact terminal 10 projected downwardly from a bottom face of the enclosure member 8. The relay further has a capacitor 13 provided between the core 1 and the movable contact terminal 10 for providing a capacitance between them.

The capacitor 13 may serve as an capacitance acting as a part of the floating static capacitance C1 between the terminals B and C. This may increase the floating static capacitance C1. This may permit that the surge voltage E0 received by the relay is well uniformly divided into the floating static capacitances C1 and C2. This may prevent the relay from any breakdown voltage among the terminals A, B and C. or the relay is kept from any breakage. This means that the relay of this embodiment possesses a high resistivity to a large surge. Then this may facilitate scaling down of the electromagnetic relay and an achievement of high speed performance of the armature.

As modifications of this embodiment, it is available to provide the capacitor 13 between either the armature 5 or the core 1 and either the movable contact terminal 10 or the movable contact spring member 7 for provided a further capacitance acting as a part of the floating static capacitance C1.

Figure 7:
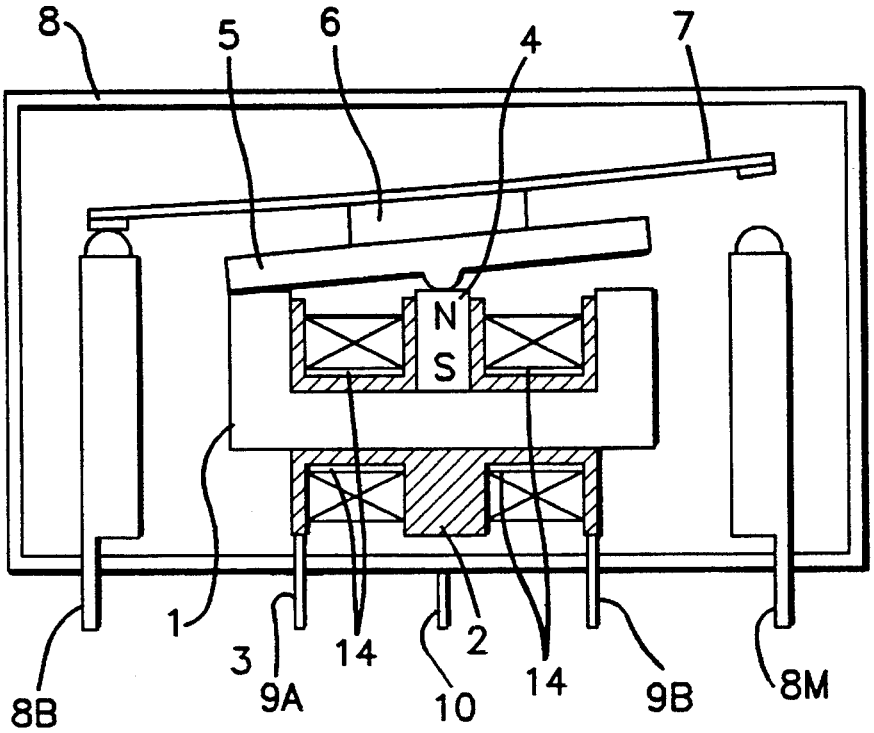
FIG. 7 is a cross sectional view illustrative of a novel polarized electromagnetic relay in a fifth embodiment according to the present invention.

A fifth embodiment according to the present invention will be described with reference to FIG. 7 in which a novel polarized electromagnetic relay having a high resistivity against any large surge voltage.

A novel polarized electromagnetic relay of this embodiment has a difference from the prior art in providing an insulating film between a spool and a coil in which the insulating film has a smaller dielectric constant than a dielectric constant of a material of the spool for reduction of the averaged dielectric constant between the coil and core to reduce a floating static capacitance between them. The polarized electromagnetic relay is accommodated in an enclosure member 8. The polarized electromagnetic relay comprises an electromagnetic driving unit, a movable contact unit and a fixed contact terminal unit. The electromagnetic driving unit comprises an U-shaped core 1, a spool 2 extending on and surrounding the core 1, a coil 3 winding the spool 2, a permanent magnet 4 having magnetic dipoles or N and S poles and coil terminals 9A and 9B projecting downwardly through a bottom of the enclosure member 8. The movable contact unit comprises an armature 5, an insulator 6 and a movable contact spring member 7. The armature 5 has a center convex portion that is kept in contact with a polar face of the permanent magnet 4 and having opposite end portions that are alternately in contact with and apart from tops of the U-shaped core 1. The movable contact spring member 7 is mechanically connected to or electrically separated from the armature 5 through the insulator 6. The polarized relay also has fixed contact terminals 8B and 8M provided around the electromagnetic driving unit. The fixed contact terminals 8B and 8M have a bottom projected downwardly from a bottom face of the enclosure member 8 and a top portion located within the enclosure member 8. The movable contact spring member 7 shows a rotation motion about its center portion caused by or together with the rotation of the armature 5 so that its opposite ends are alternately in contact with or apart from the tops of the fixed contact terminals 8B and 8M. The relay further has a movable contact terminal 10 projected downwardly from a bottom face of the enclosure member 8. The relay further has an insulating film 14 between the spool 2 and the coil 1 in which the insulating film 14 has a smaller dielectric constant in the range of from 2 to 3, while the dielectric constant of the material of the spool 2 is 3 to 6. The insulating film 14 may be made of any material having a smaller dielectric constant than the dielectric constant of the spool 2. For example, polyethylene, polypropylene, polystyrene, polytetrafluoroethylene and EFP fluorocarbon may be available as the material of the insulating film 14.

The small dielectric constant of the insulating film 14 may provide a reduction of the averaged dielectric constant between the coil and core to reduce a floating static capacitance between them. This may reduce the floating static capacitance C2. This may permit that the surge voltage E0 received by the relay is well uniformly divided into the floating static capacitances C1 and C2. This may prevent the relay from any breakdown voltage among the terminals A, B and C or the relay is kept from any breakage. This means that the relay of this embodiment possesses a high resistivity to a large surge. Then this may facilitate scaling down of the electromagnetic relay and an achievement of high speed performance of the armature.

As modifications of this embodiment, it is available to provide the insulating film 14 between the core 1 and the coil 3. Namely, it is available to provide the insulating film 14 between the spool 2 and the core 1 for reducing the floating static capacitance C2.

Whereas modifications of the present invention will no doubt be apparent to a person having ordinary skill in the art, to which the invention pertains, it is to be understood that the embodiments shown and described by way of illustrations are by no means intended to be considered in a limiting sense. Accordingly, it is to be intended to cover by claims any modifications of the invention which fall within the spirit and scope of the invention.

What is claimed is:

1. An electromagnetic relay having an improved resistivity to surge comprising:

an enclosure member accommodating said relay;

a U-shaped core provided in said enclosure member, said U-shaped core comprising a horizontal part and two vertical pats extending upward from opposite ends of said horizontal port;

a permanent magnet extending upward from a center of said horizontal part of said U-shaped core, and said permanent magnet having almost the same height as said vertical parts of said U-shaped core, coils winding around said horizontal part of said core through a spool;

at least one coil terminal electrically connected to said coils, said coil terminal extending downward from said coils and penetrating through a bottom wall of said enclosure member to the outside of said enclosure member, two fixed contact terminals vertically extending in said enclosure member, said two fixed contact terminals having bottom portions which penetrate through said bottom wall of said enclosure member to the outside of said enclosure member, said two fixed contact terminals being positioned outside said core;

an armature having a center portion in contact with a top portion of said permanent magnet, said armature exhibiting an alternate motion such that opposite ends of said armature are alternately brought into contact with and apart from top portions of said vertical parts of said U-shaped core;

a contact member having at least almost the same length as a horizontal distance between said two fixed contact terminals, said contact member being electrically separated from and mechanically connected to said armature through an insulating material having a sufficiently large dielectric constant for ensuring that a static capacitance between said armature and said coil terminal is larger than a static capacitance between said armature and said fixed contact terminals.

2. The electromagnetic relay as claimed in claim 1, wherein said insulating material comprises an engineering plastic including a foreign material having a higher dielectric constant than a dielectric constant of said engineering plastic.

3. The electromagnetic relay as claimed in claim 2, wherein said foreign material is selected from the group consisting of barium titanate, a titanic acid ceramic, alumina, steatite, mica, granite, marble, soda glass, an lead glass.

4. The electromagnetic relay as claimed in claim 3, wherein said engineering plastic is selected from the group consisting of polybutyleneterephthalate, polyetyleneterephthalate, polybutylenenaphthalate, polypropylene and polyethersulfone.

5. The electromagnetic relay as claimed in claim 3, wherein said engineering plastic comprises a liquid crystal.

6. The electromagnetic relay as claimed in claim 3, wherein said engineering plastic comprises a plastic glass.

7. The electromagnetic relay as claimed in claim 1, wherein said insulating material comprises a material selected from the group consisting of polyfluorovinyl, a silicone resin, a melamine formaldehyde resin, a nitrile rubber, a fluorine-contained rubber and a polyurethane rubber.

8. The electromagnetic relay as claimed in claim 1, further comprising a metal film provided on an inner face of a top plate of said enclosure member.

9. The electromagnetic relay as claimed in claim 8, wherein said metal film is electrically connected to said core.

10. The electromagnetic relay as claimed in claim 8, wherein said metal film is electrically connected to said armature.

11. The electromagnetic relay as claimed in claim 8, wherein said metal film is electrically connected to said armature and said core respectively.

12. The electromagnetic relay as claimed in claim 1, further comprising a capacitor provided between said core and said contact member.

13. The electromagnetic relay as claimed in claim 1, further comprising a capacitor provided between said core and said contact terminals.

14. The electromagnetic relay as claimed in claim 1, further comprising a capacitor provided between said armature and said contact member.

15. The electromagnetic relay as claimed in claim 1, further comprising a capacitor provided between said armature and said contact terminals.

16. The electromagnetic relay as claimed in claim 1, further comprising an insulating film provided between said spool and said coil.

17. The electromagnetic relay as claimed in claim 16, wherein said insulating film is made of a material selected from the group consisting of polyethylene, polystyrene, polytetrafluoroethylene and EFP fluorocarbon.

18. The electromagnetic relay as claimed in claim 1, further comprising an insulating film provided between said spool and said core.

19. The electromagnetic relay as claimed in claim 18, wherein said insulating film is made of a material selected from the group consisting of polyethylene, polystyrene, polytetrafluoroethylene and EFP fluorocarbon.

* * * * *